US006823943B2

(12) United States Patent
Baugh

(10) Patent No.: US 6,823,943 B2
(45) Date of Patent: Nov. 30, 2004

(54) STRIPPABLE COLLAPSED WELL LINER

(76) Inventor: Bemton F. Baugh, 14626 Oak Bend, Houston, TX (US) 77079

( * ) Notice: Subject to any disclaimer, the term of this patent is extended or adjusted under 35 U.S.C. 154(b) by 91 days.

(21) Appl. No.: 10/413,491

(22) Filed: Apr. 15, 2003

(65) Prior Publication Data

US 2004/0206512 A1 Oct. 21, 2004

(51) Int. Cl.[7] ..... E21B 19/22

(52) U.S. Cl. ..... 166/380; 166/85.4; 166/207; 166/242.2; 166/382; 166/384

(58) Field of Search ..... 166/380, 384, 166/385, 382, 206, 207, 77.2, 242.2, 85.4, 84.1

(56) References Cited

U.S. PATENT DOCUMENTS

| | | | | |
|---|---|---|---|---|
| 1,233,888 | A | | 7/1917 | Lednard |
| 1,494,128 | A | | 5/1924 | Primose |
| 1,563,520 | A | | 12/1925 | Owen |
| 3,028,915 | A | | 4/1962 | Jennings |
| 3,104,703 | A | | 9/1963 | Rike et al. |
| 3,297,092 | A | | 1/1967 | Jennings |
| 3,354,955 | A | | 11/1967 | Berry |
| 3,358,769 | A | | 12/1967 | Berry |
| 3,489,220 | A | | 1/1970 | Kinley |
| 3,746,092 | A | | 7/1973 | Land |
| 3,948,321 | A | | 4/1976 | Owens et al. |
| 4,501,327 | A | | 2/1985 | Retz |
| 4,673,035 | A | | 6/1987 | Gipson |
| 4,681,169 | A | | 7/1987 | Brookbank, III |
| 4,715,443 | A | | 12/1987 | Gidley |
| 4,723,579 | A | | 2/1988 | Hyodo et al. |
| 5,291,956 | A | | 3/1994 | Mueller et al. |
| 5,337,823 | A | | 8/1994 | Nobileau |
| 5,348,095 | A | | 9/1994 | Worrall et al. |
| 5,411,085 | A | | 5/1995 | Moore et al. |
| 5,425,559 | A | | 6/1995 | Nobileau |
| 5,487,411 | A | | 1/1996 | Goncalves |
| 5,494,106 | A | | 2/1996 | Gueguen et al. |
| 5,667,011 | A | | 9/1997 | Gill et al. |
| 5,718,288 | A | * | 2/1998 | Bertet et al. ..... 166/287 |
| 5,794,702 | A | | 8/1998 | Nobileau |
| 5,833,001 | A | | 11/1998 | Song et al. |
| 6,112,818 | A | | 9/2000 | Campbell |
| 6,253,850 | B1 | | 7/2001 | Nazzai et al. |
| 6,354,373 | B1 | * | 3/2002 | Vercaemer et al. ..... 166/277 |
| 6,435,281 | B1 | | 8/2002 | Baugh |
| 6,454,493 | B1 | * | 9/2002 | Lohbeck ..... 405/184.2 |
| 6,719,064 | B2 | * | 4/2004 | Price-Smith et al. ..... 166/387 |
| 2004/0055758 | A1 | * | 3/2004 | Brezinski et al. ..... 166/384 |
| 2004/0144535 | A1 | * | 7/2004 | Kalman et al. ..... 166/278 |

FOREIGN PATENT DOCUMENTS

| | | |
|---|---|---|
| WO | WO02/29207 A1 | 4/2002 |
| WO | WO02/29208 A1 | 4/2002 |

* cited by examiner

*Primary Examiner*—Hoang Dang

(57) ABSTRACT

A method of providing a liner which can be rolled up on a reel for convenient transport and which can be unrolled into the bore of an oil or gas well and expanded to the approximate bore size of the casing size which the liner was run through and is collapsed in a way which allows sealing and stripping with a blowout preventer for well control protection during running and providing smooth surface support wedging without the need for marking the pipe with slip teeth.

18 Claims, 12 Drawing Sheets

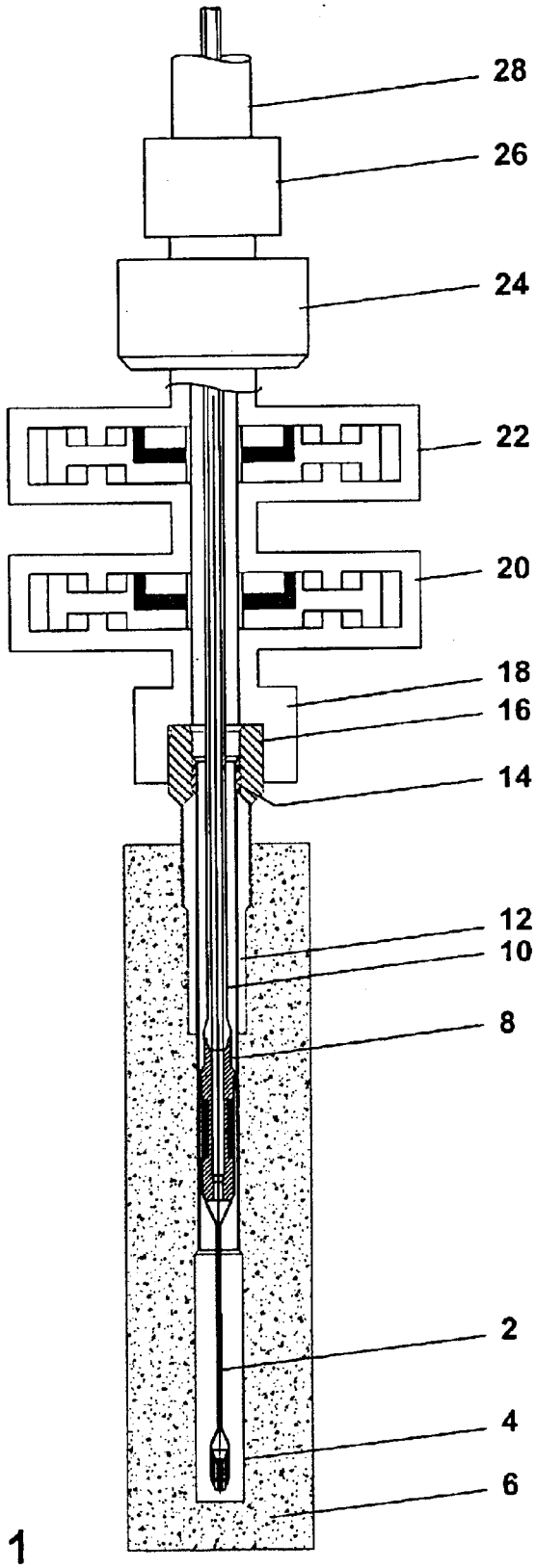
FIGURE NO. 1

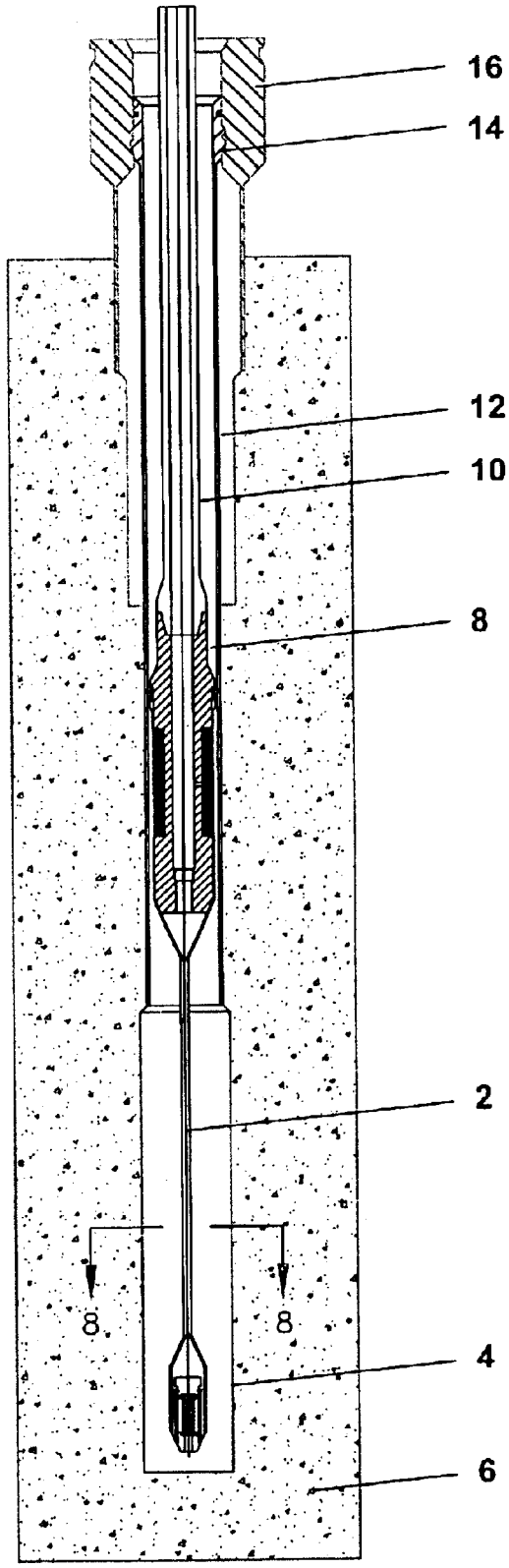
FIGURE NO. 2

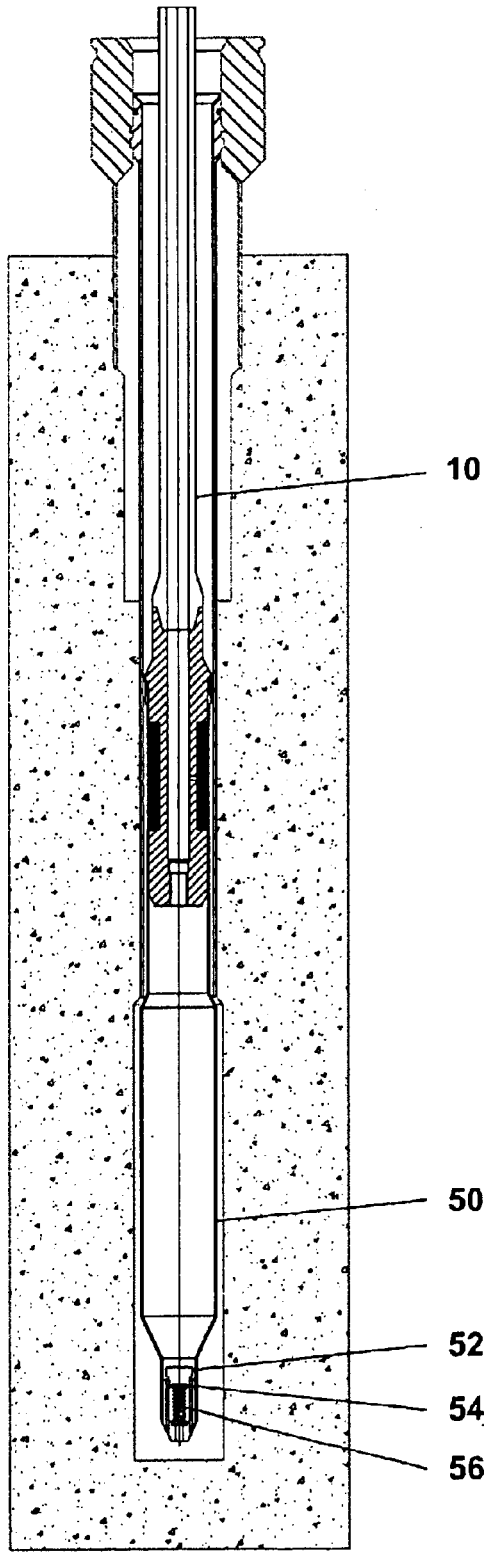
FIGURE NO. 3

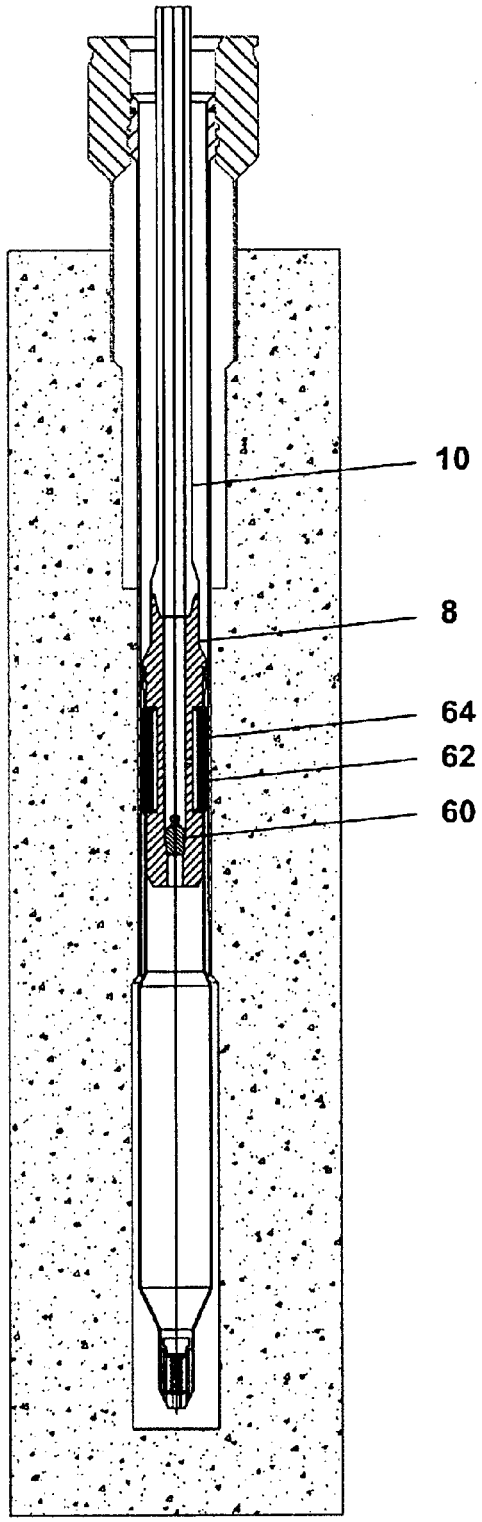
FIGURE NO. 4

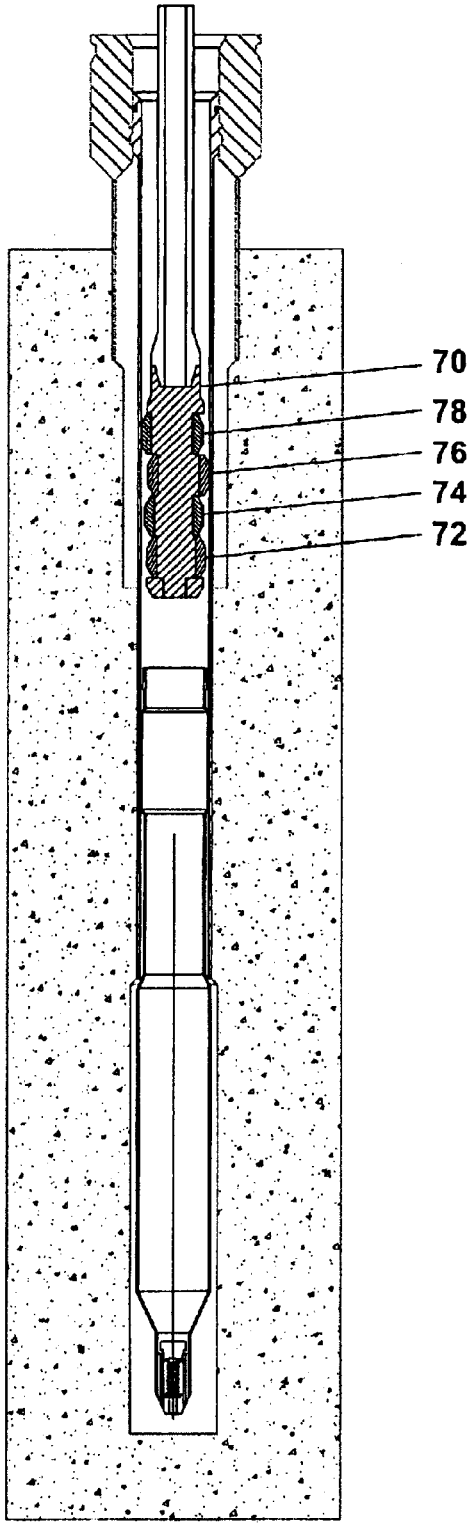
FIGURE NO. 5

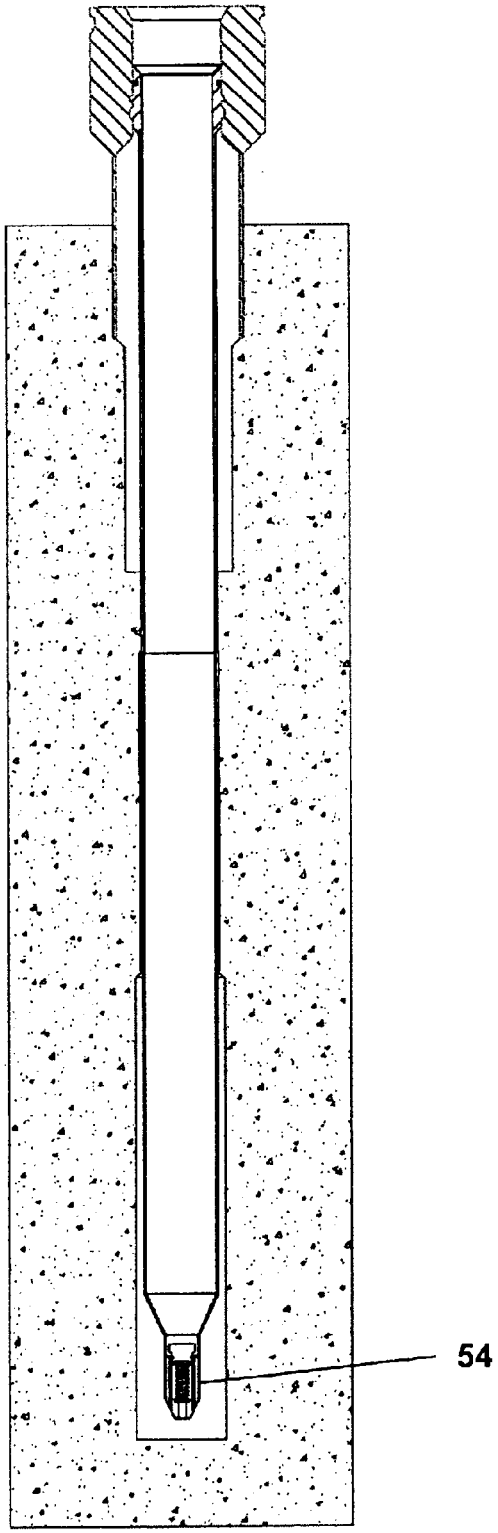
FIGURE NO. 6

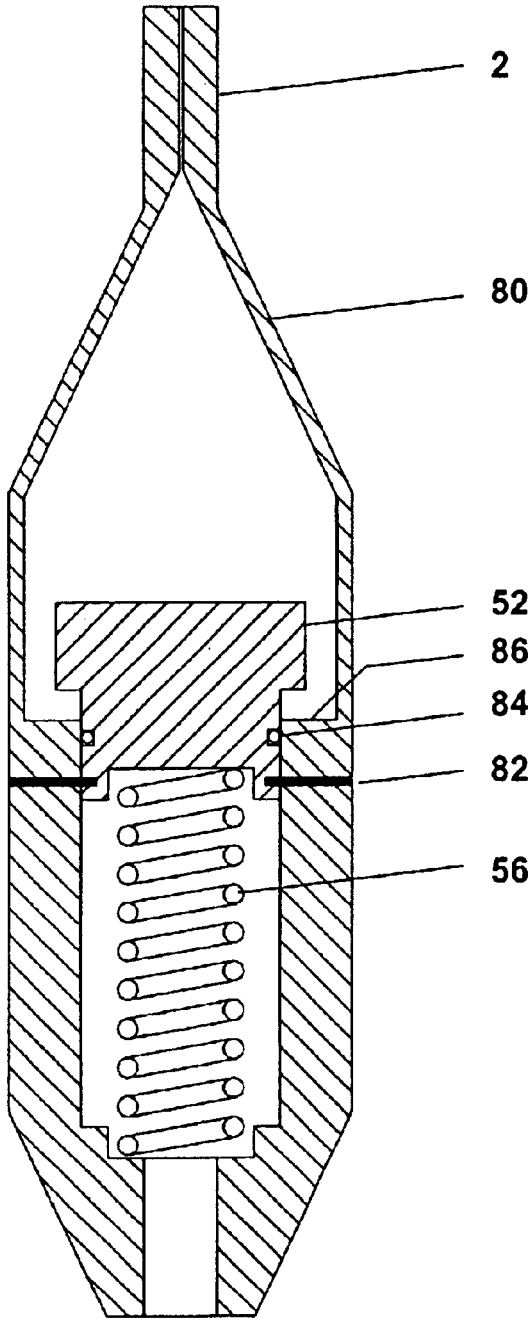
FIGURE NO. 7

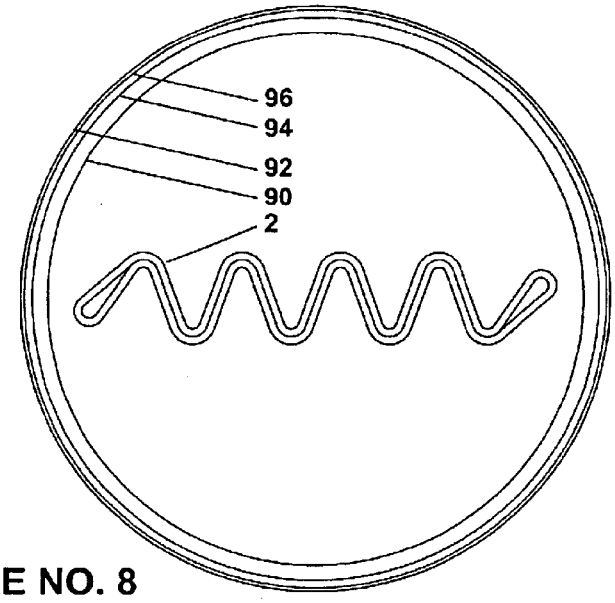
FIGURE NO. 8
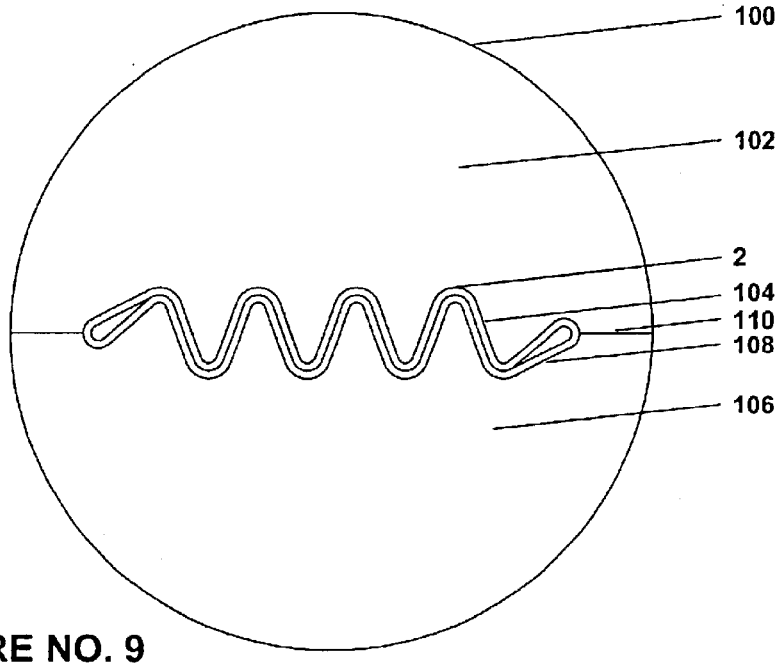
FIGURE NO. 9

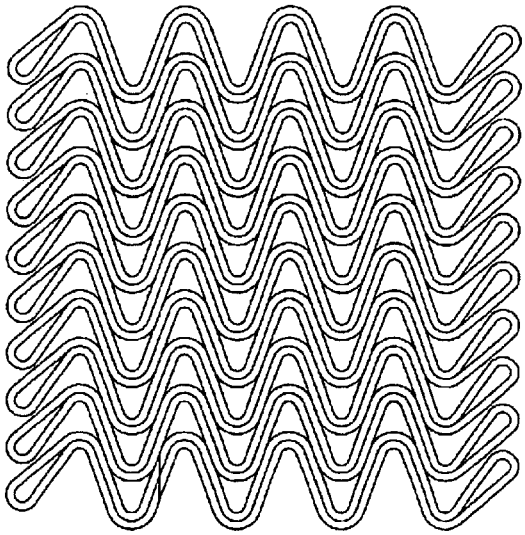
FIGURE NO. 10
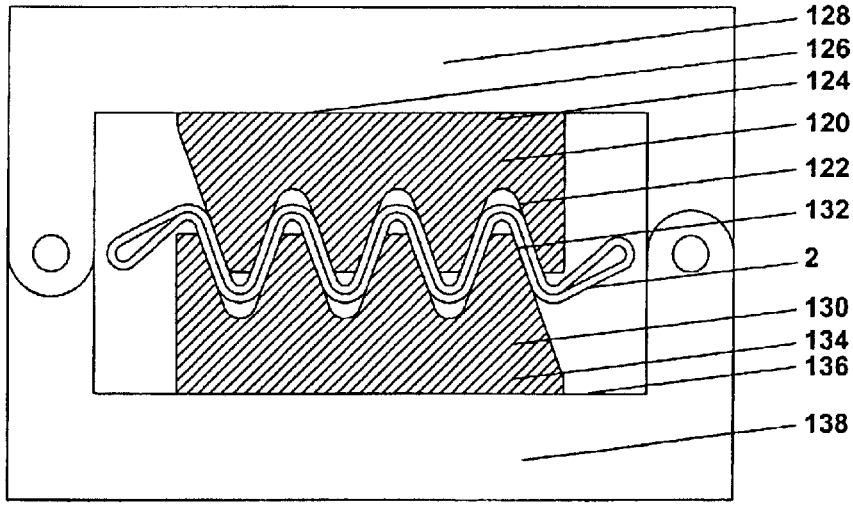
FIGURE NO. 11

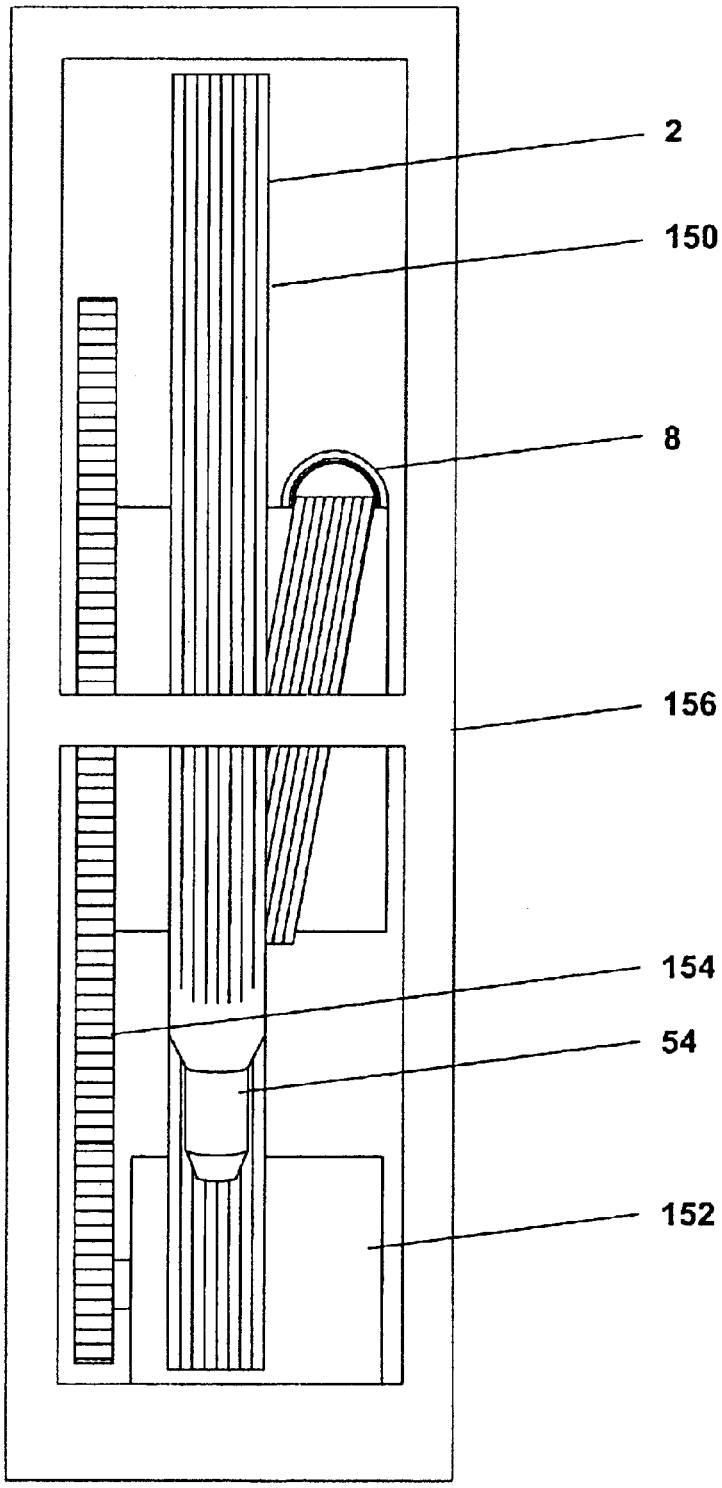
FIGURE NO. 12

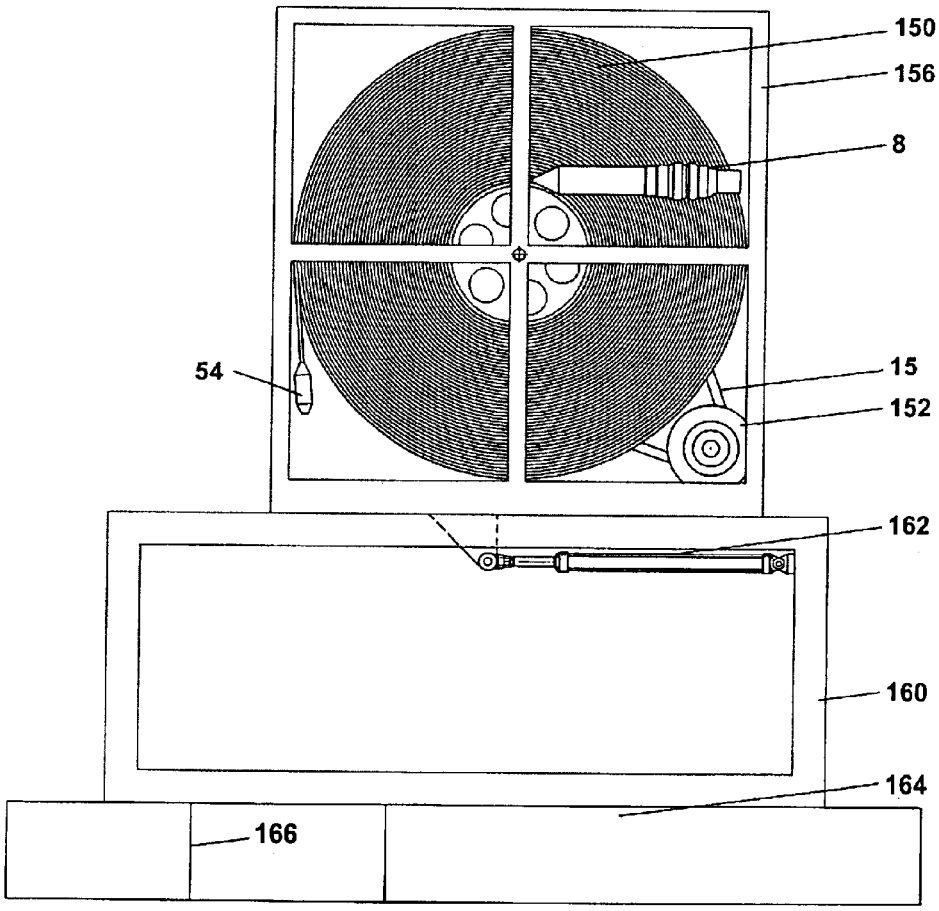
FIGURE NO. 13

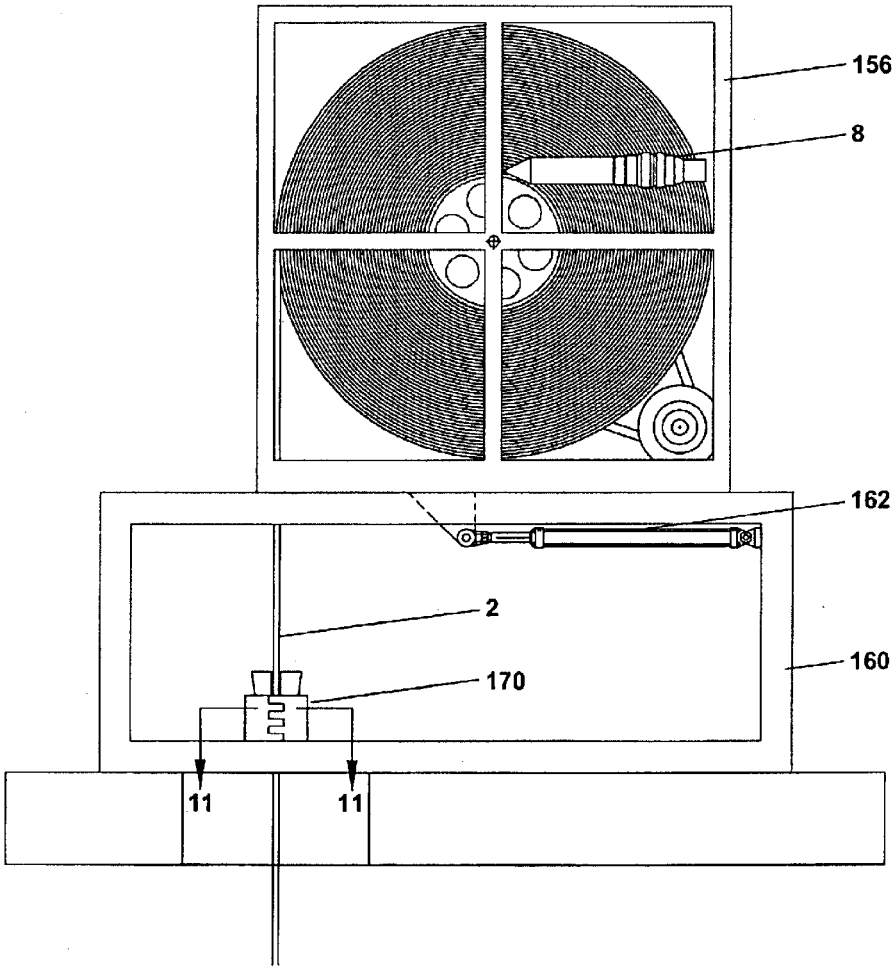
FIGURE NO. 14

STRIPPABLE COLLAPSED WELL LINER

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention is that of liner hangers for the isolation of the well bore of oil and gas wells from the earth formations through which the oil or gas well is being drilled.

As different producing formations which the drilled well will pass through must be isolated from each other, a casing string must be cemented in place to isolate each zone. An oil or gas well is typically drilled by first deciding the minimum bore of the production string of casing, or the last pipe to be cemented in place, and which will be continuous from the surface all the way down to the oil or gas producing formations. This production string of casing must be large enough to allow the production tubing landed inside it to flow enough oil or gas at sufficient volumes to make the well economic.

Each casing set point requires that an additional concentric casing string be set. A typical set of casing strings in a subsea environment from the inside out would be 7', 9.625", 11.750", 13.375", and 16" set within an 18.750" bore blowout preventer stack, 20 and 30" casing strings set before the 18.750" bore blowout preventer stack is installed. Each casing string occupies a certain amount of radial space, requiring that the next string of pipe be progressively smaller. That program provides a maximum of 5 casing set points with blowout preventer protection during drilling.

Typically, a casing string, i.e. 11.75" outer diameter, is installed in, a drill well bore suspended from the surface to a depth such as 10,000 foot depth. After cementing the 11.750" casing in place, a hole is drilled with a bit through the 11.750" casing, i.e. 10.50" diameter hole to 12,000 feet deep. Into this hole a 9.625" outside diameter casing can be landed and cemented in place. If the 9.625" casing string is suspended from the surface and is therefore 12,000 feet long, it is called a casing string. If, however, the 9.625" casing is only 2000' long and is suspended by a hanger from the lower end of the 11.750" casing string, it is called a liner. The use of a liner can save substantially on the cost of casing and cement, e.g. 10,000 feet of casing not purchased. The well program would be followed with a 7.000" casing string continuous from the surface to the bottom of the well as the production casing string.

The 9.625" liner in the example above would have saved the operator the 10,000 feet of casing not purchased, with the cost of a conventional liner hanger being generally offset by the cost of the surface casing hanger. The liner still "costs" the drilling company the "radial space", forcing the next string to be progressively larger.

In this conventional scenario, if an unexpected pressured formation is encountered and requires that an extra casing string be set, it would probably be 5.500" in outside diameter. With the 5.500" size, the tubing string landed inside would be reduced from 3" to 2", substantially restricting the flow of production from the well. Flow from wells is especially important offshore where the high cost of drilling and producing wells demands a high flow rate to be economic. Cases have been seen of abandonment of wells when an extra pressurized reservoir zone was encountered and the driller realized that his final well bore size would be too small to be economic.

Other methods, such as described in U.S. Pat. No. 6,435,281 provide for the ability to utilize liners which offer characteristics such as are listed in liners above, with the additional feature that they expand below the casing string they attach to. This means that the well bore will not be reduced a stage, making either the ultimate hole larger, or allowing one to start with a smaller string at the top. This style provides a feature that a substantial length of the liner could be rolled up on a reel and simply unrolled into the well bore for inflation. A disadvantage of this style was that during the unrolling and running operation, it was of a shape which could not be sealed on by blowout preventers to maintain well control. It depended upon having a "dead" well, or one in which the pressure head of the liquid mud column in the well bore exceeded the formation pressures. This can be of particular advantage when an actual application of the liner is to seal off an unexpected pressure zone in the formations.

SUMMARY OF THE INVENTION

The object of this invention is to provide a liner which does not occupy "radial space" in the well bore and therefore does not force each previously set casing hanger to be a step larger in diameter.

A second object of the present invention is to provide the capability of installing multiple liners in a drilling program to compensate for unforeseen well control situations.

A third object of the present invention is to provide a liner that can be rolled up for compact storage and shipment.

Another object of the present invention is to provide a liner assembly that is compact enough to be airlifted out to an offshore drilling vessel.

Another object of the present invention is to provide an expandable liner that is metallic in construction and impervious to fluid flow.

Another object of the present invention is to provide an expandable liner which can be sealed upon with a blowout preventer to provide well control during the running operations.

Another object of the present invention is to provide an expandable liner which can be supported by smooth face wedge slips which eliminate the need for marking the liner with sharp slip teeth.

BRIEF DESCRIPTION OF THE DRAWINGS

FIG. 1 is a section through the oil or gas well with a liner of the present invention unrolled into the well.

FIG. 2 is a section through the oil or gas well which eliminates the blowout preventer equipment of FIG. 1 to allow for easier viewing.

FIG. 3 is a section through the oil or gas well showing the liner inflated.

FIG. 4 is a section through the oil or gas well showing the expander in the running tool expanded.

FIG. 5 is a section through the oil or gas well showing that the running tool has been removed and a rolling expander approaching the top of the liner.

FIG. 6 is a section through the oil or gas well showing the rolling expander has expanded the liner and the lower section of the casing.

FIG. 7 is a section through the lower end of the expandable liner.

FIG. 8 is a section through the oil or gas well along lines "8—8" of FIG. 2

FIG. 9 is a section through a blowout preventer as shown in FIG. 1 showing the rams sealing on the liner as it is being run.

FIG. 10 is a section through a portion of reeled liner showing the stacking method.

FIG. 11 is a section through the support slip assembly taken along lines "11—11" of FIG. 14.

FIG. 12 is an end view of a reel holding the liner of this invention.

FIG. 13 is a side view of a reel holding the liner of this invention and sitting on a skid to assist in the deployment of the liner into a well bore.

FIG. 14 is a side view of a reel holding the liner of this invention with the liner being deployed thru a slip assembly and into the well bore.

DESCRIPTION OF THE PREFERRED EMBODIMENT

Referring now to FIG. 1, the collapsed liner 2 is shown in a bore 4 in the formations 6 and is supported by a running tool 8. The running tool 8 is supported by a running string 10 which is inside a casing string 12, which is supported by a casing hanger 14 inside a housing 16. A connector 18 is attached to housing 16 and supports two ram type blowout preventers 20 and 22, an annular type blowout preventer 24, and a flex joint 26. Riser 28 extends to the surface on a subsea well, but would not exist on a land well.

Referring now to FIG. 2, an enlarged view is shown of a portion of FIG. 1 for clarity.

Referring now to FIG. 3, area 50 shows that pressure has been pumped down running string to inflate the liner and to push the central portion 52 of the shoe 54 to shear a pin. After inflation, spring 56 pushes the central portion 52 up to allow an opening through the shoe 54. This allows cement to be circulated down to cement the lower portion of the liner in place.

Referring now to FIG. 4, a sealing dart 60 is dropped into the running tool 8 and the running string 10 is pressured to inflate the rubber element 62 to expand the portion of the liner 64. As the liner is of a relatively soft metal, it will be yielded into the casing string and will retain contact with the casing string when the pressure is removed.

Referring now to FIG. 5, the running tool 8 (from FIG. 4) is removed by right hand rotation and a rolling expander 70 is approaching the top of the liner. As the eccentric rolls 72, 74, 76, and 78 on the rolling expander 70 move into the top of the liner with a rotary motion, the non-expanded portions of the liner are expanded to the I.D. of the casing string.

Referring now to FIG. 6, a fully opened well bore is shown ready to be drilled out. The casing shoe 54 will be drilled up as drilling proceeds.

Referring now to FIG. 7, a section of the casing shoe is shown, with the collapsed liner 2 at the top going into a transition section 80. Central portion 52 is supported by shear pin 82 and is sealed by seal 84. During the initial pressure cycle of inflating the liner, the shear pin 82 is sheared and the central portion 52 moves down to land on shoulder 86. After the pressure of inflation is removed, the spring 56 pushes the central portion out and allows cement to be passed through the shoe to the annular area outside of the now inflated liner.

Referring now to FIG. 8, a cross section of the collapsed liner 2 of this invention is shown with various bends to make the rolling of the liner on a reel practical. Circle 90 shows the internal diameter of the casing being run through and circle 92 shows the external diameter of the casing. Circle 94 shows the internal diameter of the liner after it is expanded and circle 96 shows the external diameter of the liner after it is expanded.

Referring now to FIG. 9, the liner of this invention is shown going through the bore 100 of a ram type blowout preventer with blowout preventer ram 102 having front personality 104 to engage one side of the liner and blowout preventer ram 106 having a front personality 108 to engage the opposite side of the liner. It should be noted that the entire external surface of the liner 2 is engaged by seals on the relative faces of the blowout preventer rams to allow for full well protection during the running operations except for a couple of feet at each end. The interface 110 between the blowout preventer rams shows the parts of the rams which separate to allow full passage of components.

Referring now to FIG. 10, several sections of the liner are engaged as they would be when rolled layer on layer on a reel, as will be discussed in later figures.

Referring now to FIG. 11, a section through a support slip assembly as will be seen in FIG. 14 is shown. Slip segment 120 engages the collapsed liner 2 with personality 122 which matches the collapsed liner on one side. The back 124 of slip segment 120 engages surface 126 of bowl half 128. Likewise, slip segment 130 engages the collapsed liner 2 with personality 132 which matches the collapsed liner on one side. The back 134 of slip segment 130 engages surface 136 of bowl half 138. As the bowl surfaces 126 and 136 of conventional slip assemblies are normally tapered at angles from 8 degrees to 15 degrees with respect to vertical, the contact between the front personalities 122 and 132 require sharp teeth to effectively increase the coefficient of friction and ensure support of the pipe being supported. In this case, the angles of the personality 122 and 132 of the front of the slip segments 120 and 130 tend to wedge or amplify the force in comparison to the forces on the backs of the slip segments. Due to this amplification, a smooth surface can be utilized on the personalities 122 and 132 to eliminate cutting and stress concentrations on the collapsed liner.

Referring now to FIG. 12, a roll 150 of the liner 2 is shown. Shoe 54 is shown on the free end of the roll and running tool 8 is shown on the first end of the liner which was wrapped on the reel, and is offset to make the reeling practical. Motor 152 is provided to drive chain 154 and the reel of liner through appropriate sprockets. Frame 156 supports the liner for transportation.

Referring now to FIG. 13, a side view of the roll of liner 150 is shown within frame 156. Subframe 160 is shown with cylinder 162 which can move the frame 156. Subframe 160 is setting on the drilling rig floor 164 in the area of the rotary table 166.

Referring now to FIG. 14, liner 2 is shown being lowered into the well bore through slip assembly 170. As liner 2 is reeled off the roll of liner 150 and the radius of the liner on the reel is reduced, cylinder 162 is used to keep the liner 2 centralized in the well bore. As running tool 8 is in the final rotation and moves to the vertical position, the slip assembly 170 is set to support the liner. Frame 156 and subframe 160 are removed and a running string is added to the top of the liner 2. At this time the liner 2 is run as shown in FIGS. 2 through 6.

Other applications of this expandable pipe concept exist, such as sending a liner into a leaking water pipe to reestablish the pressure competence of the pipe or to seal a bare hole which has no other pipe associated with the hole.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

I claim:

1. A method of providing well bore protection between the bore of an oil or gas well and the formations outside the well bore by inserting a liner into the bore of a casing string in said oil or gas well to a position extending below the lower end of said casing string comprising providing a circumference of the outer perimeter of said liner which is greater than the circumference of the inner diameter of said casing string, collapsing said liner to a shape such that the maximum non-axial dimension of said liner is less than the internal diameter of the casing string through which it is being inserted, and in which all portions of the outer diameter of said liner can be engaged by either a first blowout preventer ram seal from a first direction or a second blowout preventer ram seal from the opposite direction.

2. The invention of claim 1, wherein said collapsing is in the form of multiple bends in the wall of said liner with alternately reversing bends of at least ninety degrees.

3. The invention of claim 2, further comprising using said reversing bends as support surfaces for said liner and using the angles to amplify the friction of support.

4. The invention of claim 1, further comprising inflating said liner in said bore.

5. The invention of claim 4, further comprising expanding the upper portion of said liner within the lower end of said casing string to support said liner.

6. The invention of claim 4, further comprising expanding the upper portion of said liner within the lower end of said casing string to seal said liner with the internal diameter of said casing string.

7. The invention of claim 4, further comprising using eccentric rollers to roll portions of said liner which are smaller than the internal diameter of said casing string to be proximately as large as the internal bore of said casing string.

8. The invention of claim 1, further comprising reeling of said liner onto a reel to allow for transportation of long lengths of said liner.

9. A method of providing a liner for a circular bore comprising providing a liner which is collapsed to a flattened shape in which the maximum non-axial dimension of said liner is less than the internal diameter of the bore through which it is being inserted, providing a shape for the external surface of said liner such that all portions of the external surface of said liner can be engaged by either a first seal from a first direction or a second seal from the opposite direction, inserting said liner into said circular bore, and inflating said liner to approximately a circular shape.

10. The invention of claim 9, further providing that circular bore is in a hole which has an existing lining which is no longer pressure competent.

11. The invention of claim 9, further providing that said circular bore is in a hole which has no existing lining.

12. The invention of claim 9, wherein said collapsing is in the form of multiple bends in the wall of said liner with alternately reversing bends of at least ninety degrees.

13. The invention of claim 12, further comprising using said reversing bends as support surfaces for said liner and using the angles to amplify the friction of support.

14. The invention of claim 9, further comprising moving said liner into said bore when there is pressure in said bore.

15. The invention of claim 14, further comprising expanding the upper portion of said liner within the lower end of said casing string to support said liner.

16. The invention of claim 14, further comprising expanding the upper portion of said liner within the lower end of said casing string to seal said liner with the internal diameter of said casing string.

17. The invention of claim 14, further comprising using eccentric rollers to roll portions of said liner which are smaller than the internal diameter of said casing string to be proximately as large as the internal bore of said casing string.

18. The invention of claim 9, further comprising reeling of said liner onto a reel to allow for transportation of long lengths of said liner.

* * * * *